US006003324A

United States Patent [19]

Shaw

[11] Patent Number: 6,003,324

[45] Date of Patent: Dec. 21, 1999

[54] MULTI-ROTOR HELICAL SCREW COMPRESSOR WITH UNLOADING

[76] Inventor: David N. Shaw, 200 D Brittany Farms Rd., New Britain, Conn. 06053

[21] Appl. No.: 08/891,453

[22] Filed: Jul. 11, 1997

[51] Int. Cl.[6] ..... F25D 17/02; F04B 49/00

[52] U.S. Cl. ..... 62/201; 62/228.5; 417/212; 418/21

[58] Field of Search ..... 418/20, 21, 197; 417/212; 62/201, 228.5

[56] References Cited

U.S. PATENT DOCUMENTS

| | | | |
|---|---|---|---|
| 1,223,734 | 4/1917 | Rinehart | 418/21 |
| 3,110,265 | 11/1963 | Miller | 418/21 |
| 3,275,226 | 9/1966 | Whitifield | 418/203 |
| 4,119,392 | 10/1978 | Breckheimer | 418/201.1 |
| 4,282,718 | 8/1981 | Koontz et al. | 62/201 X |
| 4,497,185 | 2/1985 | Shaw | 62/468 |
| 4,512,302 | 4/1985 | Bunce | 123/238 |
| 4,748,831 | 6/1988 | Shaw | 62/505 |
| 5,653,585 | 8/1997 | Fresco | 418/100 |

*Primary Examiner*—William Wayner
*Attorney, Agent, or Firm*—Cantor Colburn LLP

[57] ABSTRACT

A compressor with rotor unloading is presented. The compressor having a housing for supporting a multi-rotor configuration (e.g., a male rotor and two axially aligned female rotors) and a drive motor. A discharge disk is mounted at the discharge end of the male rotor. The length of the male rotor is slightly longer than the length of the female rotors, thereby providing axial clearance between the female rotors and the discharge disk. Lubrication is leaked (or flashed) through these clearances to upper bearings. The motor is supported in the compressor housing. Evaporated refrigerant from the evaporator is inducted into the compressor. The vapor phase refrigerant is compressed by the compressor. The compressed vapor phase refrigerant is then presented to a condenser, condensing the refrigerant to the liquid phase. Thereafter, liquid phase refrigerant is delivered through an expansion valve to the evaporator. The motor, bearings and the compression process itself are cooled and lubricated by the oil in the vapor refrigerant. The unloading is accomplished by allowing selective axial movement of the female rotors of the compressor to effectively reduce/prevent compression at that rotor. The axial movement is actuated by a stepper motor. The expansion valve is actuated and the female rotors are unloaded (i.e., the stepper motors are driven) in response to microprocessor control. Accordingly, the above describes a complete cycle which can be capacity varied.

24 Claims, 9 Drawing Sheets

MULTI-ROTOR HELICAL SCREW COMPRESSOR WITH UNLOADING

BACKGROUND OF THE INVENTION

The present invention relates to systems for cooling which employ a helical screw type compressor. More specifically, the present invention relates to unloading of a multi-screw compressor by shifting or displacing at least one of the rotors.

Cooling systems in the HVAC (heating, ventilation and air conditioning) industry are well known. By way of example, a schematic diagram of a typical cooling system is shown in FIG. 1 herein, labeled prior art. Referring to FIG. 1 herein, water enters an evaporator 412 through an input 414 where it is circulated through tubes within the evaporator and exits through an output 416. Liquid phase refrigerant enters evaporator 412 at an input 420 and evaporated refrigerant is delivered to a compressor 422 (e.g., a helical twin screw type compressor, which are well known in the art). Compressed vapor phase refrigerant is passed through an oil separator 424 for removing oil picked up in compressor 422. Thereafter the compressed vapor phase refrigerant is presented to a water cooled condenser 426 to condense the refrigerant to the liquid phase which is used for cooling, as is well known in the art. It will also be appreciated that air cooled condensers are well known and such could be used in place of the aforementioned water cooled condenser. Thereafter, liquid phase refrigerant is presented to an economizer 428 where vapor phase refrigerant (it is well known that a small portion of the refrigerant will be vapor, i.e., flash gas) is drawn off and delivered directly to the compressor. The liquid phase refrigerant is presented to input 420 of evaporator 412, thereby completing the cycle. When capacity of such a system is to be varied, it is common to unload the compressor, however, this is both inefficient and invariably, seriously complicates the overall design/cost of the compressor.

Further, helical type compressors are well known in the art. One such helical compressor employs one male rotor axially aligned (i.e., axially parallel) with and in communication with one female rotor. The pitch diameter of the female rotor is usually greater than the pitch diameter of the male rotor. Typically, the male rotor is the drive rotor, however compressors have been built with the female rotor being the drive rotor. The combination of one male rotor and one female rotor in a compressor is commonly referred to as a twin screw or rotor, such is well know in the art and has been in commercial use for decades. An example of one such twin rotor commonly employed with compressors in the HVAC (heating, ventilation and air conditioning) industry comprises a male rotor which drives an axially aligned female rotor. A resulting gap between the male and female rotors requires oil to be introduced into the compression area for sealing, however, the oil also provides cooling and lubricating, as is well known. However, the introduction of this oil requires the use of an oil separation device, to separate the oil from the refrigerant being compressed in HVAC compressors. A primary benefit of the twin rotor configuration is the low interface velocity between the male and female rotors during operation. However, the twin rotor configuration incurs large radial bearing loads and thrust loads. The obvious solution to alleviating the bearing load problem would be to install sufficiently sized bearings. This is not a feasible solution, since the relative diameters of the rotors in practice result in the rotors being too close together to allow installation of sufficiently sized bearings.

The prior art has addressed this problem, with the introduction compressors employing 'so-called' single screw technology. A single screw configuration comprises a drive rotor with two opposing axially perpendicular gate rotors. The gate rotors are generally comprised of a composite material which allows positioning of the gate rotor with small clearances from the drive rotor. These clearances are small enough that the liquid refrigerant itself provides sufficient sealing, the liquid refrigerant also provides cooling and lubrication. The rearward positioning of gate rotors and the positioning on opposing sides of the drive rotor, (1) allows equalizing suction of pressure at both ends of the drive rotor thereby virtually eliminating the thrust loads encountered with the above described twin screw system and (2) balances the radial loading on the drive rotor thereby minimizing radial bearing loads. However, the interface velocity between the gate rotors and the drive rotor are very high. Accordingly, a common problem with this system is the extensive damage suffered by the rotors when lubrication is lost, due to the high interface velocities of the rotors.

SUMMARY OF THE INVENTION

The above-discussed and other drawbacks and deficiencies of the prior art are overcome or alleviated by the method and apparatus for unloading, a compressor of the present invention. In accordance with the present invention, a compressor has a housing for supporting a multi-rotor configuration (e.g., a male rotor and two axially aligned, i.e., axially parallel, female rotors) and a drive motor. The drive shaft of the motor is integral with or coupled to the shaft of the male rotor for driving the same. A bearing is mounted at this shaft in between the motor and the male rotor and is supported in a lower bearing plate attached to the compressor housing by a plurality of spaced apart support arms. The female rotors have shafts with bearings mounted thereon which are supported by the lower bearing plate.

The rotors are disposed in a shell comprising open and closed off portions which depend from or are attached to the compressor housing. The closed off portions are located for accomplishing compression.

A discharge plate is mounted at the discharge end of the rotors. The discharge plate includes discharge port openings, female rotor shaft openings and a recess for receiving a discharge disk. A clearance is defined between the outer circumference of the discharge disk and the inner circumferential surface of the recess. An inwardly countersunk surface depends from the inner circumferential surface, which allows the clearance between the discharge disk and the inner circumferential surface to be sealed by the entrained liquid, thereby minimizing leakage back to the low pressure side of the compressor. The discharge end of the male rotor being sealed by the discharge disk causes the pressure on both ends of the male rotor to be equalized. The countersunk surface terminates at an opening with the male rotor shaft having a bearing spacer thereon, disposed therein. The compression and discharge ends of the rotors communicate with the discharge porting in the discharge plate.

The length of the male rotor is slightly longer than the length of the female rotors, thereby providing axial clearance between the female rotors and the discharge plate in a fully loaded position. Further, there are clearances between each of the female rotor shafts and the respective pass through openings and between the edge of the discharge disk and the recess in the discharge plate. Lubrication entrained in the vapor is leaked (or flashed) through these clearances to the bearings described below for lubricating the same.

The motor is supported in the compressor housing by a plurality of spaced apart members depending inwardly from the housing.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
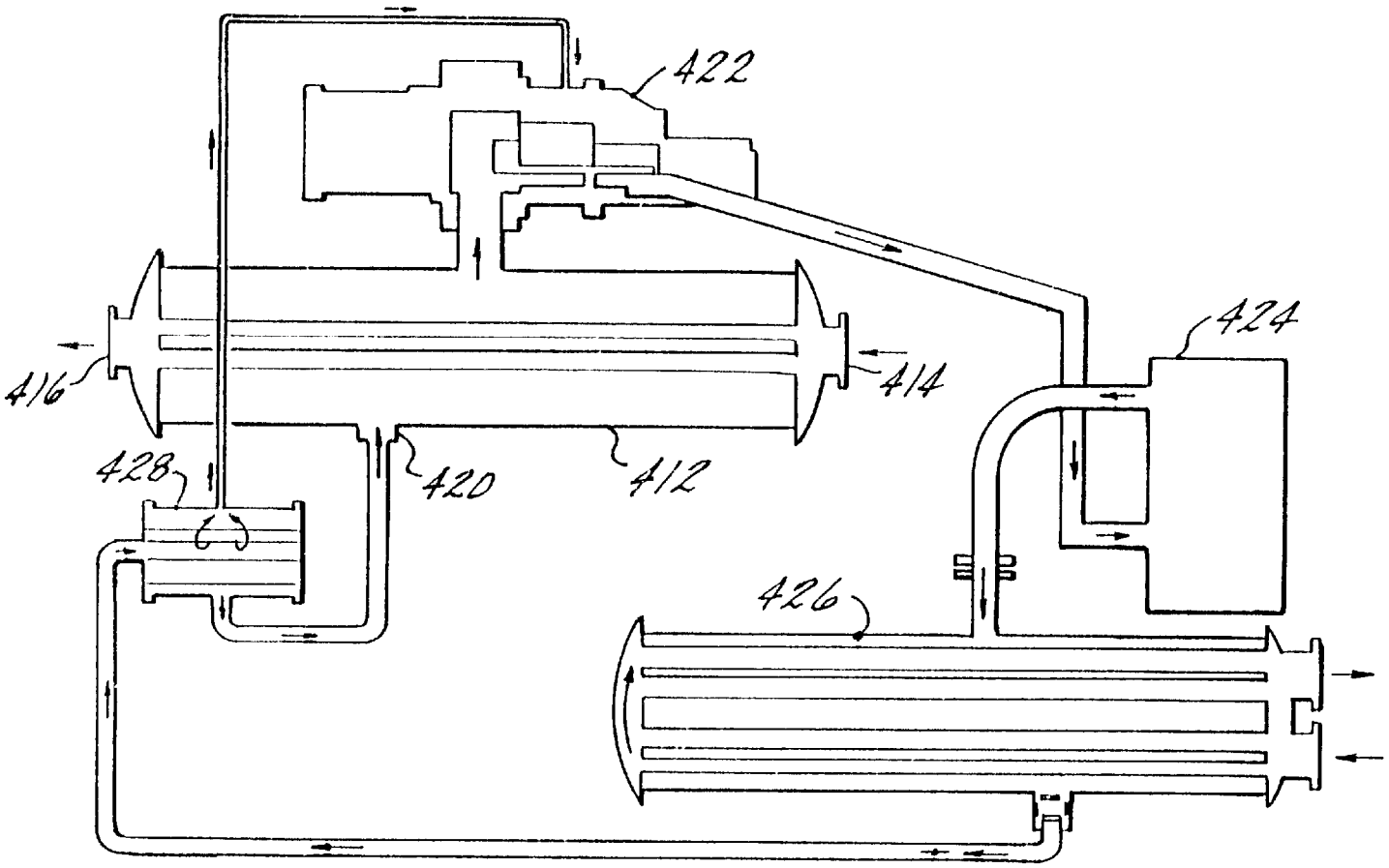
FIG. 1 (PRIOR ART)
FIG. 1 a schematic diagram of a vapor compression cooling system in accordance with the prior art.
Figure 2:
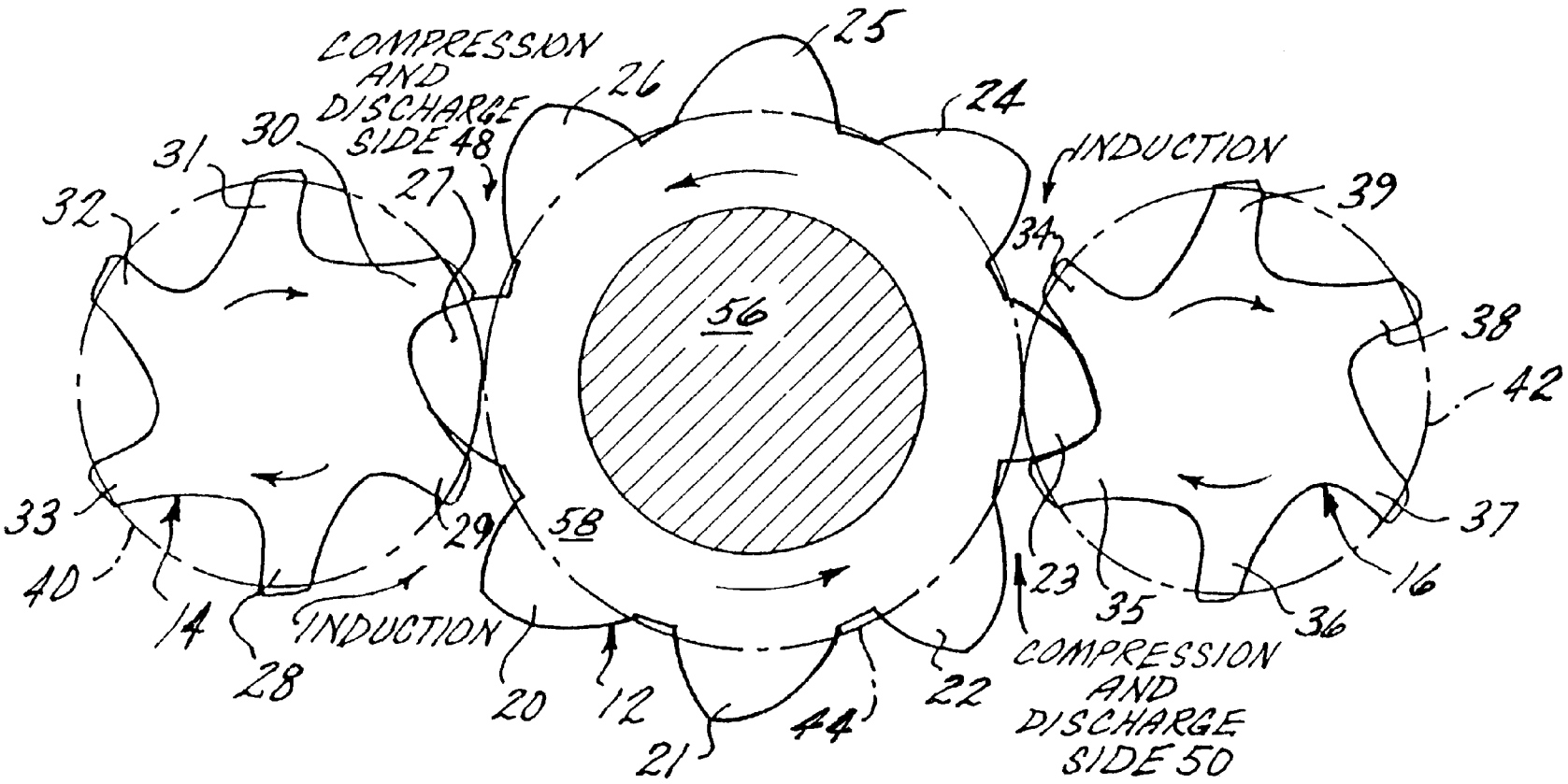
FIG. 2 is a diagrammatic cross sectional view of a tri-rotor configuration in accordance with the present invention.

Referring now to FIG. 2, a cross sectional view of a rotor configuration axially used in a compressor 10 is generally shown. A male rotor 12 is axially aligned (i.e., axially parallel) with and in communication with female rotors 14 and 16. Male rotor 12 is driven by motor 18, described hereinafter. In this example, male rotor 12 has eight lobes (teeth) 20–27 with a 150° wrap, female rotor 14 has six flutes (teeth) 28–33 with a 200° wrap, and female rotor 16 has six flutes 34–39 with a 200° wrap. The pitch diameters 40, 42 of the female rotors 14, 16 are less than the pitch diameter 44 of the male rotor 12. Accordingly, the compression phase of the axial sweep with respect to male rotor 12 occupies 180° of mace rotation.

Male rotor 12 comprises an inner cylindrical metal shaft 56 with an outer composite material ring 58 mounted thereon, such being more fully described in U.S. patent application Ser. No. 08/550,253, entitled MULTI-ROTOR HELICAL SCREW COMPRESSOR, which is expressly incorporated herein by reference. The clearance between the male and female rotors is small enough, due to the use of the composite material, that the oil/liquid refrigerant provides sufficient sealing and cooling, however, a small amount (percent by weight) of oil which is miscible in the refrigerant also provides cooling and lubrication. Accordingly, the need to inject oil into the compression area, such as in the prior art twin screw compressors for sealing, cooling and lubricating is eliminated because of the composite material, whereby the compressor can be adequately lubricated with low viscosity liquid refrigerant/oil therein.

Figure 3:
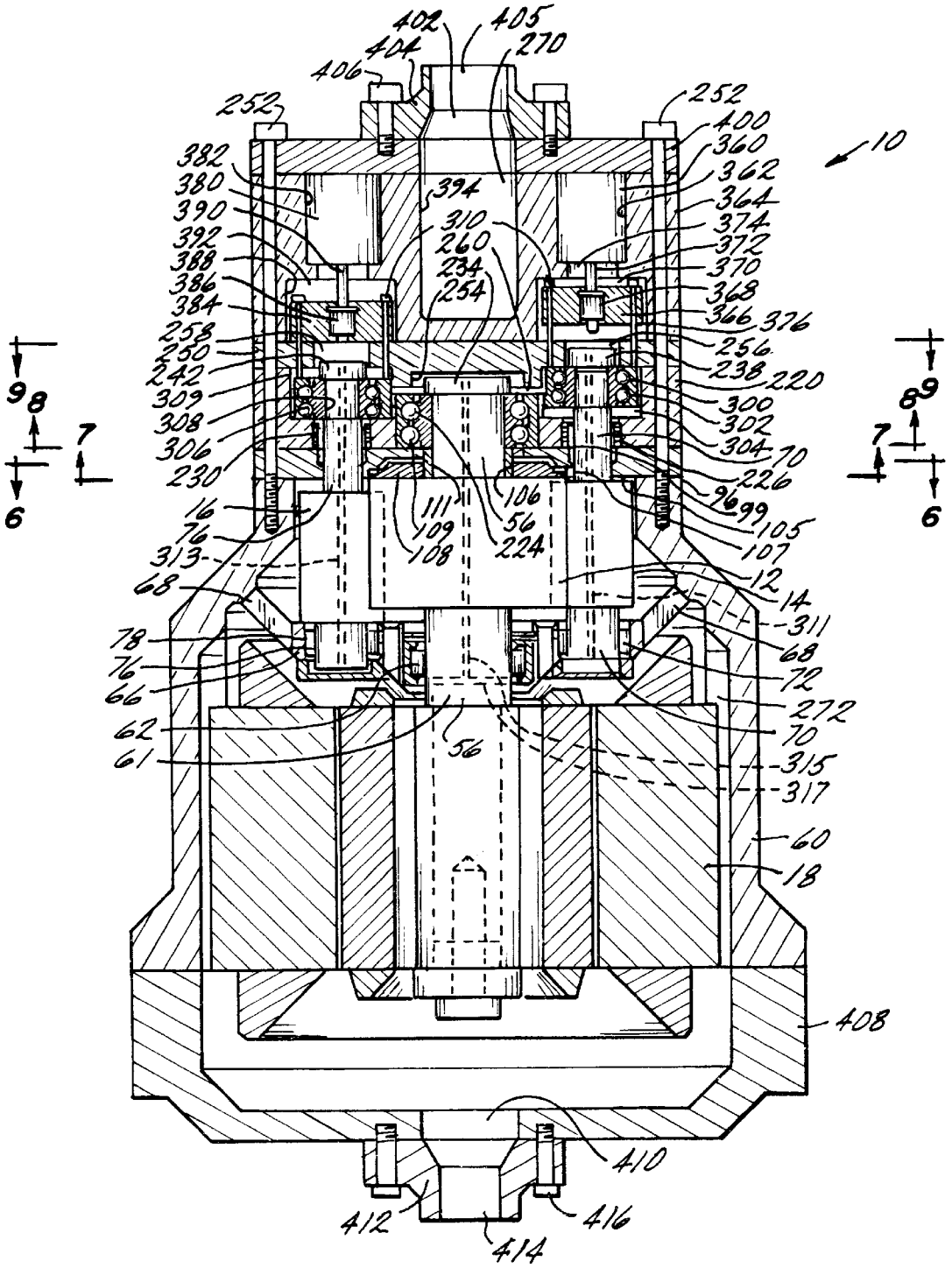
FIG. 3 is a cross sectional view of a compressor with rotor unloading in accordance with the present invention.
Figure 4:
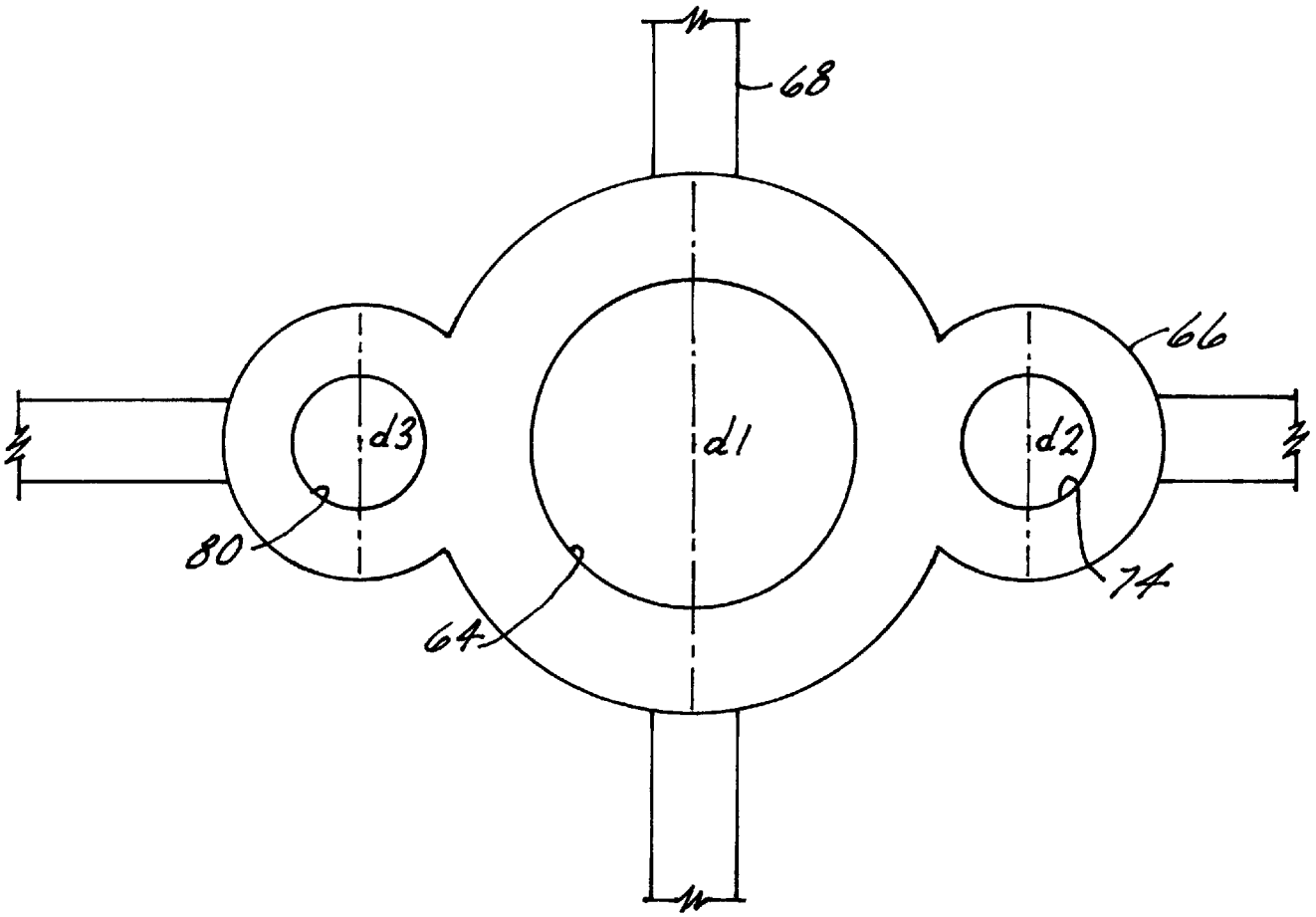
FIG. 4 is a view of the lower bearing plate of the compress or of FIG. 3.

Referring to FIG. 3, compressor 10 employing the above described rotor configuration is generally shown. Compressor 10 has a housing 60 for supporting the rotors and drive motor 18. Motor 18 has a drive shaft 61 which is integral with or coupled to shaft 56 of male rotor 12 for driving the same. A bearing 62 is mounted at shaft 56 in between motor 18 and rotor 12 and is supported within an opening 64 in a lower bearing plate 66 (FIG. 4). The diameter $d_1$ of plate 66 is preferably about the same as the root diameter of male rotor 12. Plate 66 is attached to housing 60 (or is formed integral therewith) by a plurality of spaced apart support arms 68 extending outwardly and upwardly from plate 66 to housing 60. Female rotor 14 has a shaft 70 with a bearing 72 mounted thereat which is supported within a recess 74 of plate 66. Female rotor 16 has a shaft 76 with a bearing 78 mounted thereat which is supported within a recess 80 of plate 66. The diameters $d_2$ and $d_3$ are preferably about the same as the respective root diameters of female rotors 14 and 16.

Figure 5:
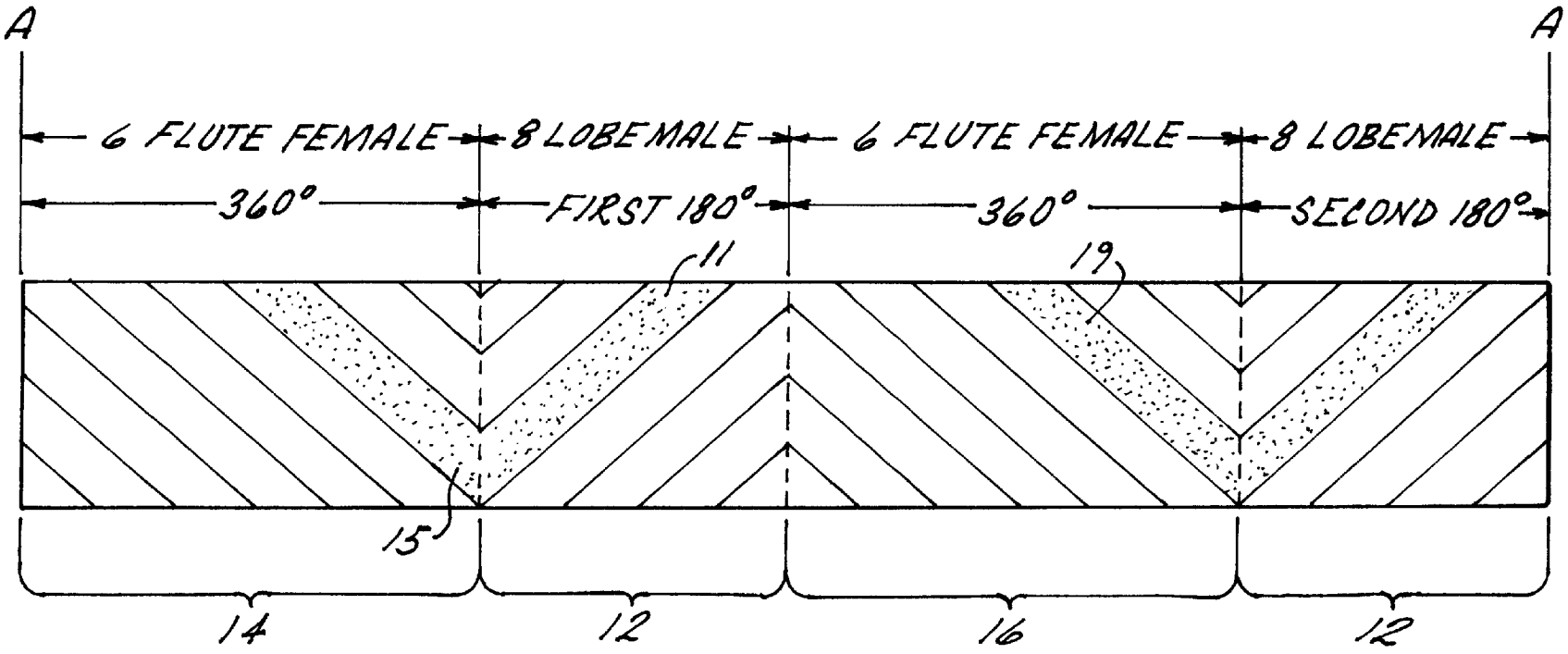
FIG. 5 is a diagrammatic unwrapped pitch line study of the tri-rotor configuration of FIG. 2 illustrating the rotor shell configuration of the compressor of FIG. 3.

Referring to FIG. 5, a diagrammatic unwrapped pitch line study is provided for the present rotor configuration. The male rotor is shown in two equal sections for purposes of illustration. Moreover, the open and closed off portions of a rotor assembly shell 11, which is disposed about the rotors, is shown. Shell 11 is comprised of these closed off portions 15 and 19 which depend from or are attached to housing 60 or any other suitable structure of the compressor (e.g., the discharge plate, described below). Closed off portions 15 and 19 are permanently located as shown in FIG. 5, whereby the position of the rotors is selected and shown to aid in the description of the shell. Portions 15 and 19 close off equal volumes for compression.

Figure 6:
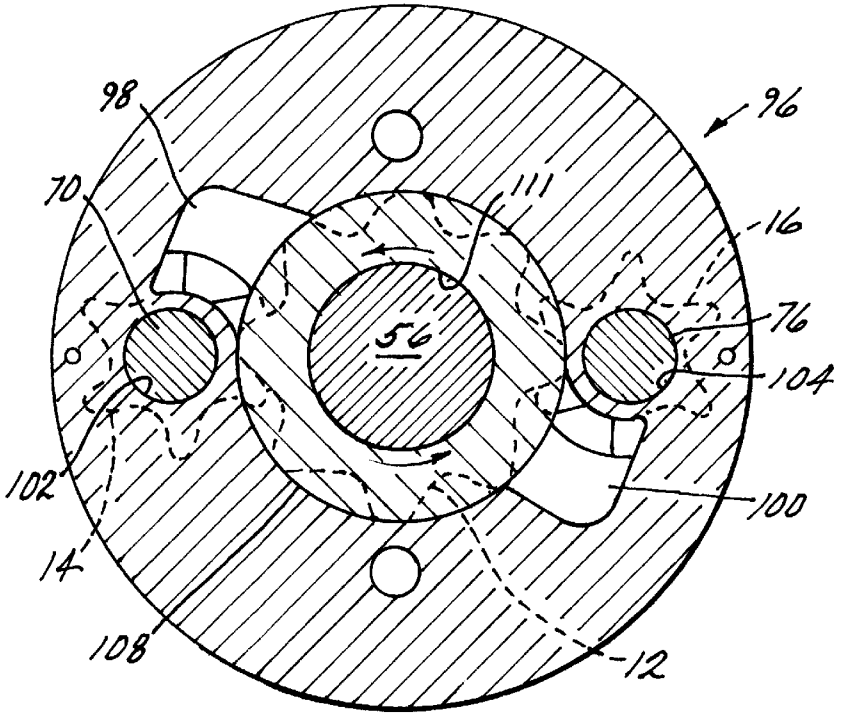
FIG. 6 is a view taken along the line 6—6 of FIG. 3.
Figure 7:
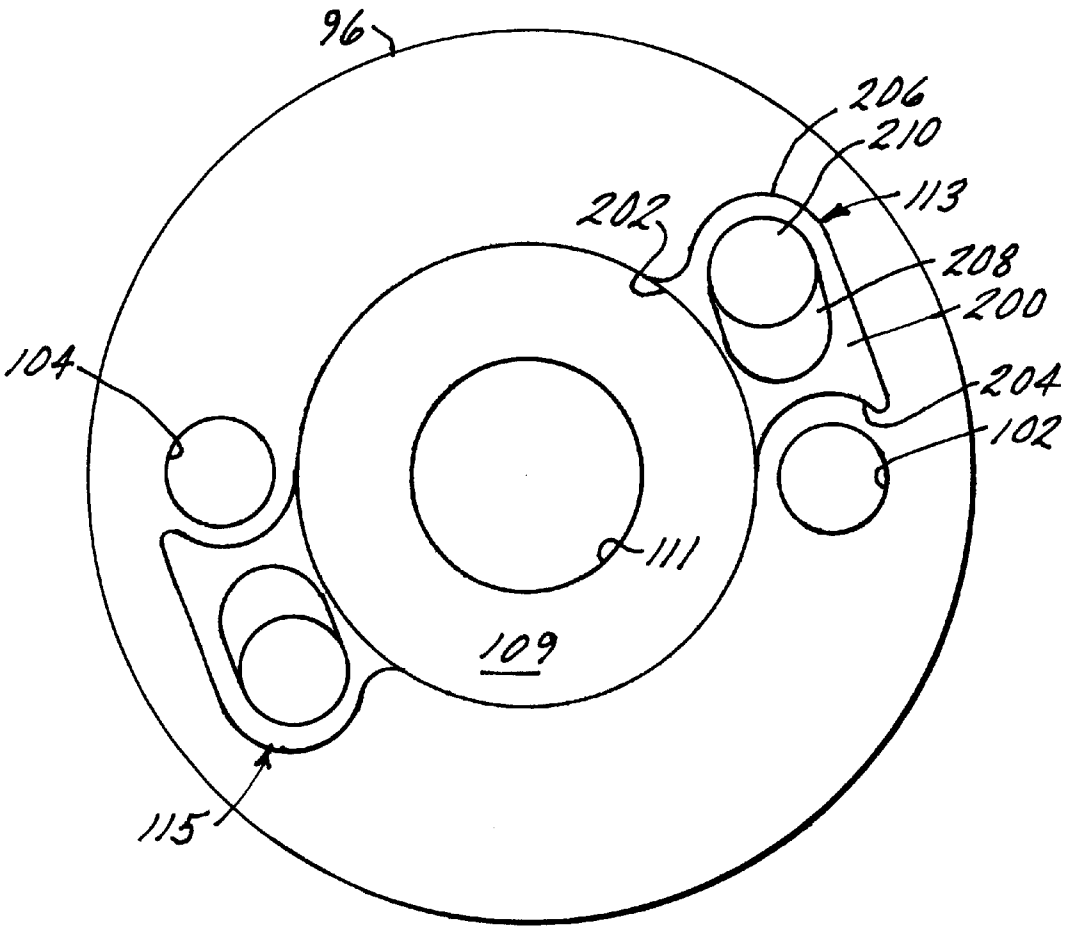
FIG. 7 is a view taken along the line 7—7 of FIG. 3 with the thrust disk removed for clarity.

Referring to FIGS. 3, 6 and 7, a discharge plate 96 is mounted at the discharge end of the rotors. Plate 96 includes discharge port openings 98 and 100, openings 102 and 104 for pass through of the shafts 70, 76 of the female rotors and a recess 106 for receiving a discharge disk 108. A clearance is defined between the outer circumference of disk 108 and the inner circumferential surface 107 of recess 106. An inwardly countersunk surface 109 depends from surface 107, which allows the clearance between disk 108 and surface 107 to be sealed by the entrained liquid, thereby minimizing leakage back to the low end of the compressor. This clearance being controlled by, for example, labyrinth teeth on the outside diameter of the disk or with the use of a floating seal. Moreover, the discharge end of the male rotor 12 being sealed by disk 108 causes the pressure on both ends of male rotor 12 to be equalized. As is readily apparent to one of ordinary skill in the art, the high pressure at the interface of the discharge end of the male rotor 12 and the disk 108 acts on disk 108 in the direction of discharge and acts on the lobes of the male rotor 12 in an equal and opposite direction. These equal and opposite forces almost eliminate of the thrust loads on the male rotor. Countersunk surface 109 terminates at an opening 111 with the shaft 56 of the male rotor, having a bearing spacer 99 thereon, disposed therein. Compression and discharge end 48, FIG. 2, (i.e., the corresponding radial discharge area of male rotor 12 and the axial discharge port area of female rotor 14) communicates with discharge porting 113 and compression and discharge end 50, FIG. 2, (i.e., the corresponding radial discharge area of male rotor 12 and the axial discharge port area of female rotor 16) communicates with discharge porting 115.

Discharge porting 113 comprises a first stepped down portion 200 defined by a line 202 which represents the circumferential distance encompassed when surface 200 intersects inner circumferential surface 107, an edge 204 which follows the root diameter of female rotor 14 and a curved edge 206 which communicates with the periphery of the remaining radial and axial port areas, such areas being well known and defined in the art. This first stepped down portion 200 provides relief on the female rotor end of the trapped pocket, since such will be aligned with this portion. Trap pocket relief being more fully described in U.S. Pat. No. 5.642,992, entitled MULTI-ROTOR HELICAL SCREW COMPRESSOR, which has been incorporated herein by reference. A second further stepped down portion 208 depends from stepped down portion 200 and generally aligns with the axial port area of female rotor 14. Both portions 200 and 208 lead into a discharge opening 210 which generally aligns with the radial flow area. The discharge opening from discharge porting 113 and 115 are later combined and form a single discharge output for the compressor.

The length of the male rotor is slightly longer than the length of the female rotors, thereby providing axial clearance 105 between the female rotors and disk 108 in a fully loaded position described hereinafter (i.e., the position of rotor 14 in FIG. 3). Bearing spacer 99 has a length equal to the thickness of plate 96. Further, there are clearances between each of the female rotor shafts and the respective pass through openings and between the edge of discharge disk 108 and recess 106, as is clearly shown in FIG. 3. Lubrication entrained in the vapor is leaked (or flashed) through these clearances to the bearings described below for lubricating the same.

The outside diameter of disk 108 is equal to the crest diameter of the male rotor 12. Disk 108 equalizes suction pressure at both ends of male rotor 12 thereby virtually eliminating the thrust loads encountered with the prior art twin screw compressors. It will be appreciated that disk 108 blocks the axial port area of the male rotor 12, however it is believed that the benefit obtained by the elimination of thrust loads outweighs the slight reduction in overall discharge port area. It should be noted that a significant portion of the axial port area of the male rotor 12 is occupied by a lobe of the rotor. Further, disk 108 having a diameter equal to the crest diameter of the male rotor 12 will not block the radial discharge port area of male rotor 12, or the axial discharge port areas of female rotors 14 and 16, or the radial discharge porting areas of female rotors 14 and 16.

Figure 8:
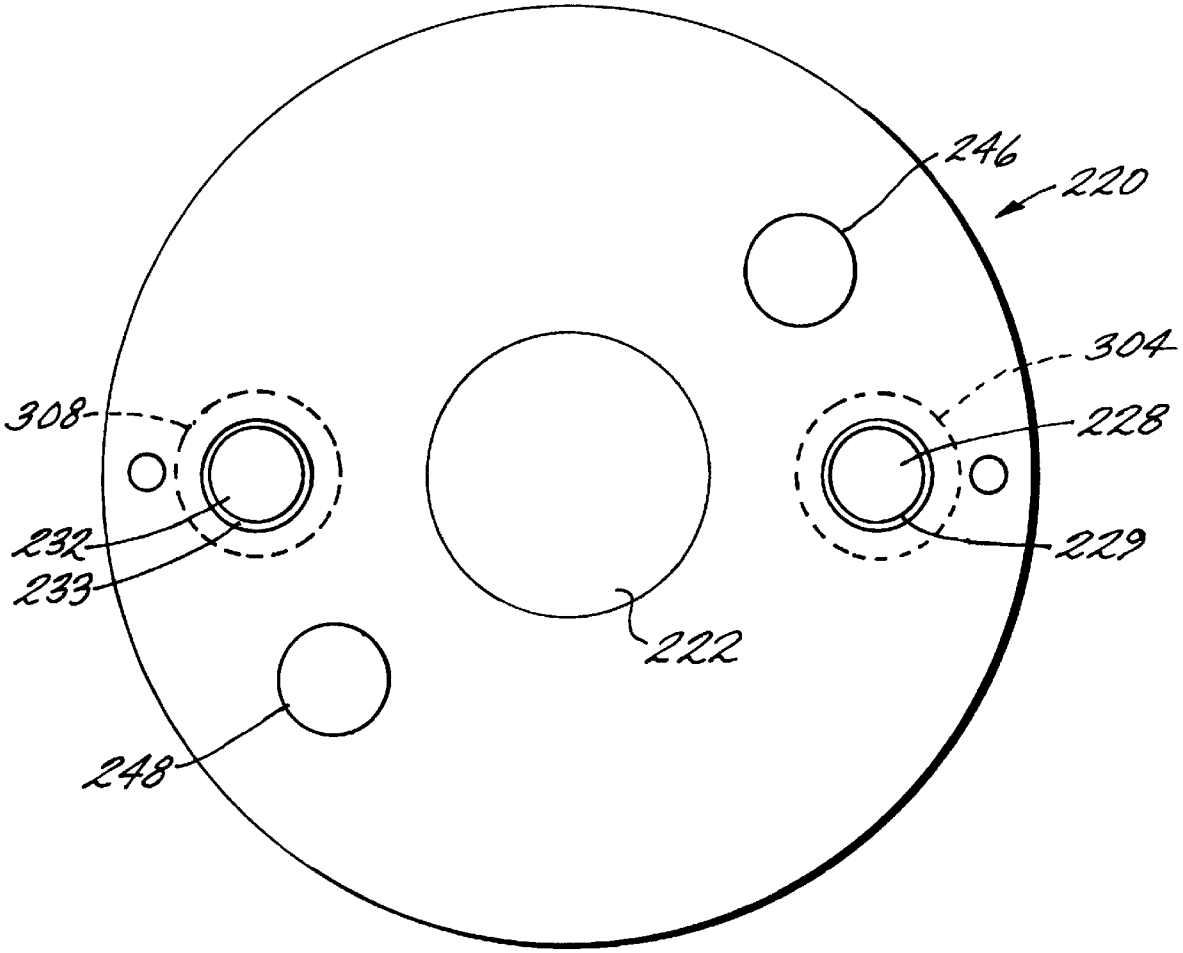
FIG. 8 is a view taken along the line 8—8 of FIG. 3 of the upper bearing plate of the compressor of FIG. 3.

Referring to FIGS. 3 and 8, an upper bearing plate 220 has an opening 222 with a bearing 224 supported therein, at the inner race thereof by bearing spacer 99 and at the outer race thereof by plate 96. Bearing 224 is mounted at shaft 56 at the discharge side of rotor 12. A bearing 226 is mounted at shaft 70 of female rotor 14 and is supported within an opening 228 of plate 220 by the upper surface of plate 96 and a ledge 229 of plate 220. A bearing 230 is mounted at shaft 76 of female rotor 16 and is supported within an opening 232 of plate 220 by the upper surface of plate 96 and a ledge 233 of plate 220. The inner race of bearing 224 is retained about shaft 56 by an end cap 234 which is attached at the end of shaft 56. A bearing 300 is retained on shaft 70 of female rotor 14 at the inner race thereof by a retaining ledge 302 and an end cap 238'. End cap 238 is attached to shaft 70 at the end thereof. Bearing 300 is disposed within an opening 304 of plate 220 sufficient for allowing shifting (in FIG. 3 vertical displacement) of bearing 300 therein. A bearing 306 is retained on shaft 76 of female rotor 16 at the inner race thereof by a retaining ledge 308 and an end cap 242. End cap 242 is attached to shaft 76 at the end thereof. Bearing 306 is disposed within an opening 309 of plate 220 sufficient for allowing shifting (in FIG. 3 vertical displacement) of bearing 306 therein.

The lubrication leaked (or flashed) through the above described clearances provides lubrication for bearings 224, 226, 230, 300 and 304. Shafts 70 and 76 of rotors 14 and 16, respectively, have longitudinal channels 311 and 313 therethrough for collecting/receiving the lubricant (oil/liquid) at the discharge end thereof and delivering the same to bearings 72 and 78 for lubrication thereof. This flow back to induction is induced by the exposure of the induction ends of channels 311 and 313 to the low side of the rotors. Also, shaft 56 has a longitudinal channel 315 which terminates at the induction end, in a channel 317 extending diametrically through shaft 56. Lubricant (oil/liquid) is collected/received at the discharge end of channel 315 and is delivered through channels 315 and 317 to bearing 62 for lubrication thereof. This flow back to induction is induced by the exposure of the induction end of channel 315 to the low side of the rotors. Plate 220 includes pass through discharge port openings 246 and 248.

Figure 9:
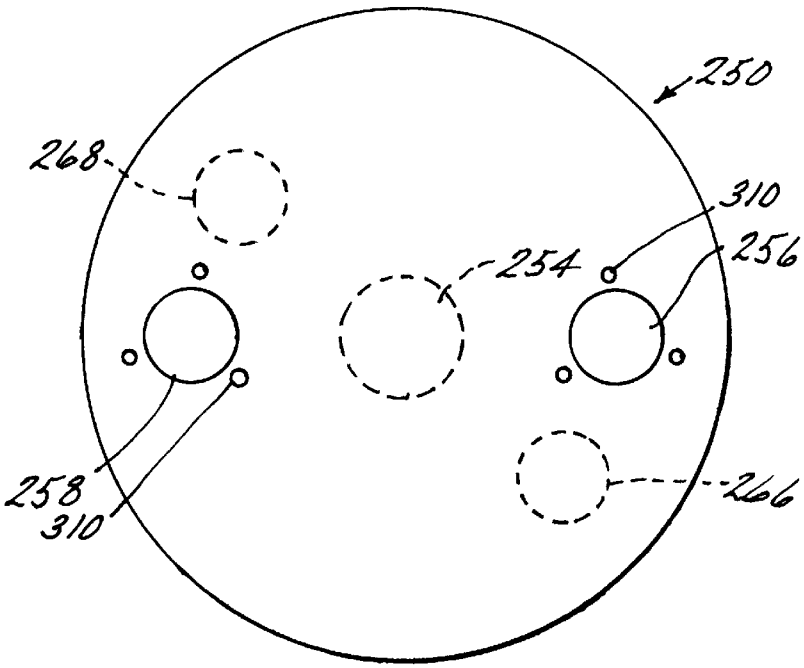
FIG. 9 is a view taken along the line 9—9 of FIG. 3 of an upper plate of the compressor of FIG. 3.

Referring to FIGS. 3 and 9, plate 250 has a recess 254 for receiving end cap 234, an opening 256 for receiving end cap 238, and an opening 258 for receiving end cap 242. Plate 250 has an opening a plurality of openings (e.g., three openings) 310 about each opening 256 and 258. A belville washer 260 is disposed between the outer race of bearing 224 and plate 250. Plate 250 includes discharge port passage ways 266 and 268 therein.

Figure 10:
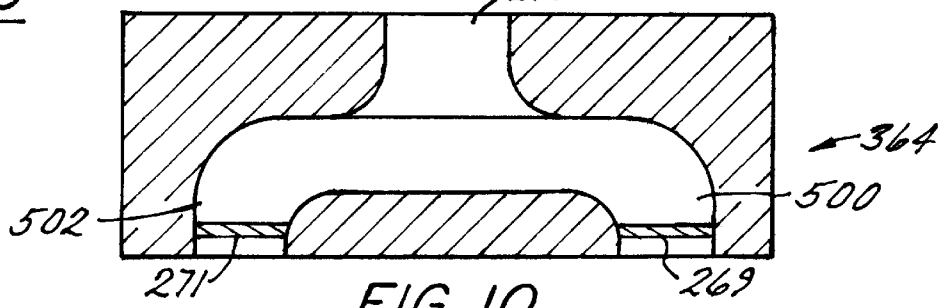
FIG. 10 is a cross sectional view of an upper plate of the compressor of FIG. 3.

Referring to FIGS. 3 and 10, a discharge port passage way 500 in a plate 364 cooperates at one end thereof with discharge port passage way 266 in plate 250 and a discharge port passage way 502 in plate 364 cooperates at one end thereof with discharge port passage way 268. Discharge port passage ways 500 and 502 lead to an outlet passage way 270. A check valve 269 is mounted in discharge port passage way 500 and a check valve 271 is mounted in discharge port passage way 502 for prohibiting flow back to the respective rotor, particularly when that corresponding rotor is unloaded, as described herein.

A stepper motor 360 is supported in an upper recess 362 in a plate 364. An actuator block 366 having a threaded follower sleeve 368 mounted therein is supported in a corresponding lower recess 370 in plate 364. A drive shaft 372 of motor 360 extends through an opening 374 (between recesses 362 and 370) in plate 364 and is coupled with sleeve 368 in block 366. Block 366 carries pins 376 which pass through 310 in plate 250 and are attached to bearing 300. Rotor 14 is shown in FIG. 3 in a fully loaded position with stepper motor 360 (and thereby block 366, bearing 300, shaft 70 and rotor 14) in a retracted position (upwardly in FIG. 3).

A stepper motor 380 is supported in an upper recess 382 in a plate 364. An actuator block 384 having a threaded follower sleeve 386 mounted therein is supported in a corresponding lower recess 388 in plate 364. A drive shaft 390 of motor 380 extends through an opening 392 (between recesses 382 and 388) in plate 364 and is coupled with sleeve 386 in block 384. Block 384 carries pins 394 which pass through opening 310 in plate 250 and are attached to bearing 306. Rotor 16 is shown in FIG. 3 in a fully unloaded position with stepper motor 380 (and thereby block 384, bearing 306, shaft 76 and rotor 16) in an extended position (downwardly in FIG. 3).

With rotors 14 and 16 in the fully loaded position (i.e., the position of rotor 14 in FIG. 3), at least one of the rotors can be partially unloaded or fully unloaded to vary the capacity of the compressor. As a rotor is extended (i.e., driven downwardly in FIG. 3) leakage between the rotor and shell 11 is provided, thereby allowing leverage. Continued extension of the rotor will result in further unloading of that rotor, i.e., position where virtually no net flow occurs. It is an important feature of the present invention that compression/system capacity is varied by the above-described unloading of the rotors.

While stepper motors are described herein any actuator device (e.g., full stroke electric motor, solenoids or hydraulic or pneumatic actuated positions) may suffice for driving the blocks and thereby the rotors as described above. As it is preferred that this movement be precisely controlled to allow for partial unloading of the rotors, stepper motors are well suited for such applications.

A discharge end plate 400 is mounted on plate 364. Fasteners 252 secure plates 96, 220, 250, 364 and 400 to housing 60, as is shown in FIG. 3. Plate 400 has an opening 402 in communication with outlet passage way 270 in plate 364. An outlet (or discharge) fitting 404 having a compressor outlet 405 therein is mounted to plate 400 by fasteners 406. Compressor outlet 405 is in communication, at one end thereof, with opening 402.

Referring to FIG. 3, motor 18 is supported in housing 60 by a plurality of spaced apart members 272 depending inwardly from housing 60. Motor 18 may be a variable speed motor, whereby compressor capacity can be controlled by varying motor speed which directly varies drive rotor 12 speed. An induction end plate 408 is mounted at one end of housing 60. Plate 408 has an inlet passage way 410 therein. An inlet (or induction) fitting 412 having a compression inlet 414 therein is mounted to plate 408 by fasteners 416. Compression inlet 414 is in communication, at one end thereof, with passage way 410.

Figure 11:
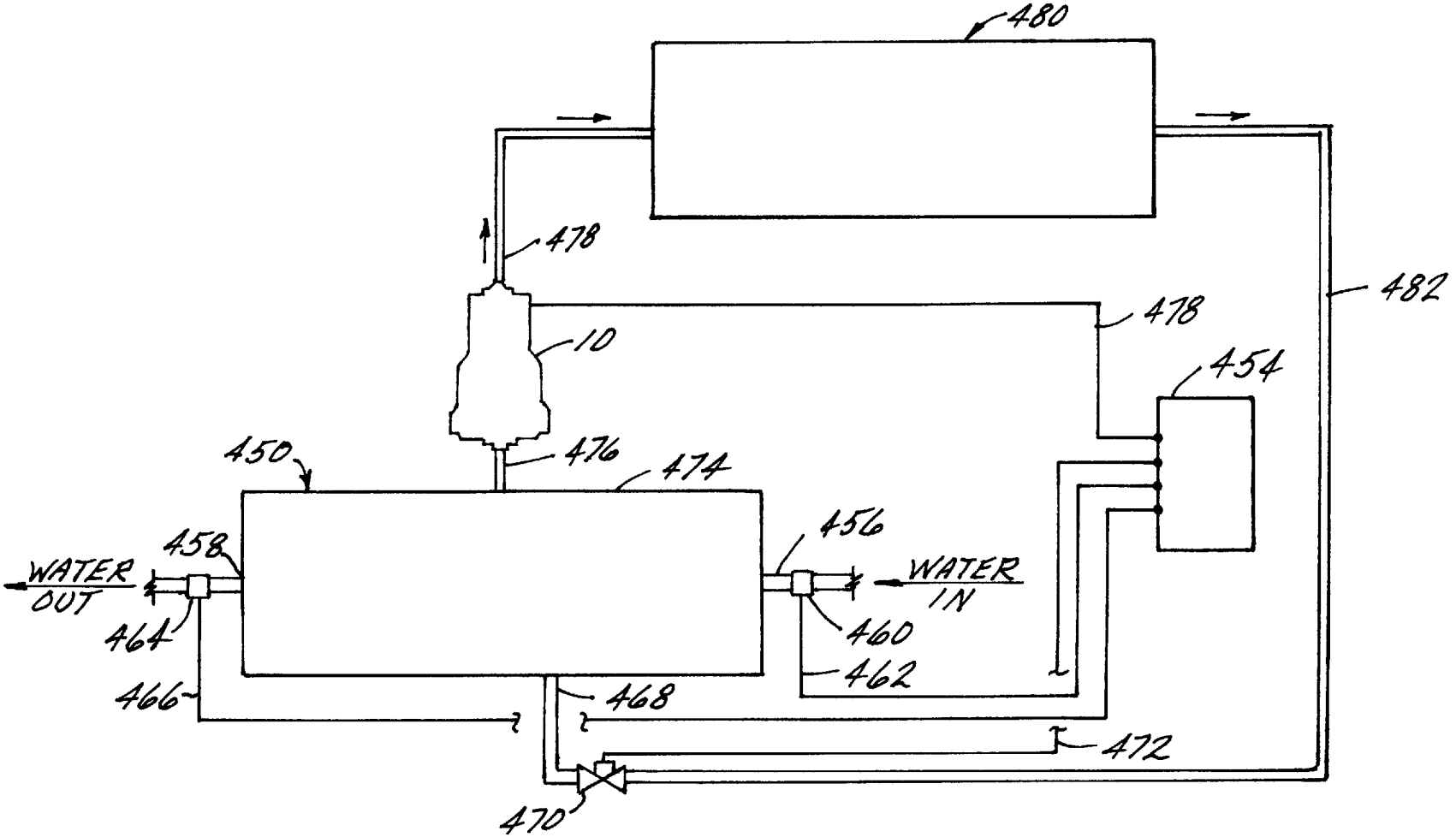
FIG. 11 is a schematic diagram of a variable capacity vapor compression cooling system in accordance with the present invention.

Referring to FIG. 11, a schematic diagram of a variable capacity vapor compression cooling system in accordance with the present invention. In this example, air conditioning requirements are entered into a microprocessor 454 which controls the system, as described below. Water enters evaporator 450 through an input 456 where it is circulated through tubes within the evaporator and exits through an output 458. As in the prior art, when water temperature rises system capacity is increased and when water temperature drops system capacity is decreased. The entering water temperature is measured by a thermocouple 460 which sends a signal indicative of the entering water temperature to microprocessor 454, via a line 462. The exiting or leaving water temperature is measured by a thermocouple 464 which sends a signal indicative of the exiting water temperature to microprocessor 454, via a line 466. Although not shown the temperature of the water is regulated, with the temperature of the water being controlled by microprocessor 454 in response to the measured temperatures. The regulation of the water temperature allows control of the rate of evaporation of the liquid phase refrigerant in evaporator 450. Liquid phase refrigerant enters evaporator 450 at an input 468, with the rate of flow into evaporator 450 controlled by an electronic expansion valve 470, which is itself controlled by microprocessor 454 via a line 472. Evaporated refrigerant is delivered to compressor 10 through an output 474 of evaporator 450 over a line 476.

Evaporated refrigerant (i.e., vapor phase refrigerant) is inducted (drawn) into the compressor at the suction end thereof. The vapor phase refrigerant is compressed by the compressor. Stepper motors 360 and 380 are controlled by microprocessor 454, via a line 478. System capacity is varied by unloading the compressor, i.e., driving the stepper motors to control the loading of rotors 14 and 16.

The compressed vapor phase refrigerant is then presented by a line 478 to an air (or water) cooled condenser 480, condensing the refrigerant to the liquid phase, as is well known in the art. Thereafter, liquid phase refrigerant is delivered by a line 482 to expansion valve 470, as described above. Control of this flow of liquid phase refrigerant to the evaporator provides additional control of system capacity. For example, turning down (i.e., restricting flow) valve 470 will reduce system capacity, such typically being done in conjunction with unloading the rotors.

As is well known, the liquid refrigerant in the evaporator is boiled resulting in an oil rich vapor refrigerant. The motor, bearings and the compression process itself are cooled and lubricated by the oil/liquid in the vapor. The vapor is drawn into the suction end of the rotors and is compressed. The oil/liquid in the vapor seals and cools the compression process and also serves as a lubricant source for the bearings.

While the above described embodiment has been described with a male rotor having eight lobes, whereby eight discharge pulses per revolution of the male rotor are generated for each of the female rotor for a total of sixteen pulses per revolution, it may be preferred that a male rotor having nine lobes (i.e., an odd number) be employed. The sixteen pulses per revolution actually only generate eight pulses per revolution, since two pulses occur at the same time, i.e., one for each of the female rotors. With a male rotor having nine lobes, eighteen pulses per revolution are generated, i.e., nine pulses per revolution for each of the two female rotors. However, none of these eighteen pulses occur during another one of the pulses, thereby generating a more even or smoother discharge flow, i.e., less noise.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A compressor comprising:

a housing having an inlet and an outlet;

a first rotor disposed in said housing, said first rotor comprising a male rotor having a plurality of lobes with a degree of wrap and includes a generally cylindrical metal shaft and a ring having said lobes integrally depending therefrom, said ring disposed on said shaft for rotation therewith, said ring comprised of a composite material;

at least one second rotor disposed in said housing and in communication with said first rotor, whereby said first rotor drives said at least one second rotor, said at least one second rotor comprises at least one female rotor having a plurality of flutes with a degree of wrap, said at least one second rotor being axially parallel with said first rotor; and at least one actuator in operable communication with said at least one second rotor capable of selectively shifting said at least one second rotor axially relative to said first rotor between a retracted position and an extended position and a position therebetween varying compression at said first rotor and said at least one second rotor.

2. A compressor comprising:

a housing having an inlet and an outlet;

a first rotor disposed in said housing, said first rotor comprising a male rotor having a plurality of lobes with a degree of wrap;

at least one second rotor disposed in said housing and in communication with said first rotor, whereby said first rotor drives said at least one second rotor, said at least one second rotor comprises at least one female rotor having a plurality of flutes with a degree of wrap, said at least one second rotor being axially parallel with said first rotor; and at least one actuator in operable communication with said at least one second rotor capable of selectively shifting said at least one second rotor axially relative to said first rotor between a retracted position and an extended position and a position therebetween varying compression at said first rotor and said at least one second rotor, a discharge disk disposed at a discharge end of said male rotor, said discharge side plate being generally cylindrical and having an outside diameter about the same as a crest diameter of said male rotor.

3. The compressor of claim 2 further comprising:

a discharge plate disposed at the discharge end of said first rotor and said at least one second rotor, said discharge plate defining discharge porting therein, said discharge portion including, an inner circumferential surface for receiving said discharge disk, with a clearance being defined between said inner circumferential surface and an outer circumference of said discharge disk, a countersunk surface depending from said inner circumferential surface and terminating at an opening, said countersunk surface depending from said inner circumferential surface allows said clearance to be sealed by a liquid in said compressor, and at least one discharge porting scheme positioned for communication with a discharge port area of said at least one female rotor.

4. The compessor of claim 3 wherein said at least one discharge porting scheme comprises:

a first stepped down portion defined by an intersection of said counter sunk surface and said inner circumferential surface, an edge which generally follows a root diameter of said at least one female rotor and a curved edge which communicates with a periphery of remaining discharge port areas of said male rotor and said at least one said female rotor, whereby said first stepped down portion provides trap pocket relief;

a second stepped down portion depending from said first stepped down portion, said second stepped down portion generally aligned with an axial discharge port area of said at least one female rotor; and wherein said first and second stepped down portions lead to a discharge opening generally aligned with a radial discharge area of said male rotor and said axial discharge port area of said at least one female rotor.

5. A discharge compressor comprising:

a housing having an inlet and an outlet;

a first rotor disposed in said housing;

at least one second rotor disposed in said housing and in communication with said first rotor, whereby said first rotor drives said at least one second rotor; and at least one actuator in operable communication with said at least one second rotor capable of selectively shifting said at least one second rotor axially relative to said first rotor between a retracted position and an extended position and a position therebetween varying compression at said first rotor and said at least one second rotor;

a discharge disk disposed at a discharge end of said first rotor; and wherein said first rotor is longer than said second rotor to provide axial clearance between said second rotor and said discharge disk.

6. The compressor of claim 5 further comprising:

an upper first rotor bearing mounted on a first rotor shaft of said first rotor;

an upper second rotor bearing mounted on a second rotor shaft of said second rotor;

a discharge plate disposed at the discharge end of said first rotor and said at least one second rotor, said discharge plate defining discharge porting therein, said discharge plate having a first opening for passthrough of said first rotor shaft, a second opening for passthrough of said second rotor shaft and a recess for receiving said discharge disk, first bearing spacer disposed on said first rotor shaft at said first opening in said discharge plate, said first bearing spacer having a length equal to about the thickness of said discharge plate; and a second bearing spacer disposed on said second rotor shaft at said second opening in said discharge plate, said second bearing spacer having a length equal to about the sum of the difference between the length of said first and second rotors and the thickness of said discharge plate;

whereby clearances are defined between each of said first and second bearing spacers and respective said first and second openings in said discharge plate and between said discharge disk and said recess in said discharge plate, whereby liquid is leaked through said clearances to said upper first and second rotor bearings for lubrication thereof.

7. A compressor comprising:

a housing having an inlet and an outlet;

a first rotor disposed in said housing;

at least one second rotor disposed in said housing and in communication with said first rotor, whereby said first rotor drives said at least one second rotor, said first rotor being longer than said second rotor to provide axial clearance between said second rotor and said discharge disk;

at least one actuator in operable communication with said at least one second rotor capable of selectively shifting said at least one second rotor axially relative to said first rotor to reduce compression at said first rotor and said at least one second rotor;

a discharge disk disposed at a discharge end of said first rotor;

an upper first rotor bearing mounted at a first rotor shaft of said first rotor;

an upper second rotor bearing mounted at a second rotor shaft of said second rotor;

a discharge plate disposed at the discharge end of said first rotor and said at least one second rotor, said discharge plate defining discharge porting therein, said discharge plate having a first opening for pass through of said first rotor shaft, a second opening for pass through of said second rotor shaft and a recess for receiving said discharge disk, a first clearance defined within said recess between said discharge plate and said discharge disk, said actuator in a first position positioning said at least one second rotor to define a second clearance between said at least one second rotor and discharge plate, whereby liquid is leaked through said first and second clearances to said upper first and second rotor bearings for lubrication thereof.

8. The compressor of claim 7 further comprising:

a motor coupled to said first rotor for driving said first rotor.

9. The compressor of claim 8 wherein said motor comprises a variable speed motor.

10. The compressor of claim 7 wherein said actuator comprises an electric motor.

11. The compressor of claim 10 wherein said electric motor comprises a stepper motor.

12. The compression of claim 11 wherein said stepper motor includes a drive shaft coupled to said at least one second rotor, whereby rotation of said drive shaft by said stepper motor shifts said at least one second rotor axially relative to said first rotor.

13. A compressor as claimed in claim 7 wherein said actuator comprises a solenoid.

14. The compressor of claim 7 wherein:

said first rotor comprises a male rotor having a plurality of lobes with a degree of wrap; and said at least one second rotor comprises at least one female rotor having a plurality of flutes with a degree of wrap, said at least one second rotor being axially parallel with said first rotor.

15. The compressor of claim 14 wherein said at least one female rotor comprises two, three, four or five female rotors.

16. A variable capacity cooling system comprising:

a compressor comprising, (1) a housing having an inlet and an outlet, (2) a first rotor disposed in said housing, (3) at least one second rotor disposed in said housing in communication with said at least one second rotor, whereby said first rotor drives said at least one second rotor, (4) at least one actuator in operable communication with said at least one second rotor capable of selectively shifting said at least one second rotor axially relative to said first rotor between a retracted position and an extended position and a position therebetween varying compression at said first rotor and said at least one second rotor;

(5) a motor coupled to said first rotor for driving said first rotor; a condenser receptive to the compressed vapor phase refrigerant from said outlet of said compressor, said condenser for condensing the compressed vapor phase refrigerant to provide the liquid phase refrigerant; and an evaporator receptive to liquid phase refrigerant from said condenser, said evaporator for evaporating the liquid phase refrigerant therein, said evaporator including a tube for circulating water with the temperature of the water being measured whereby capacity of said system is varied, said tube having a water input and a water output; and a valve for regulating flow of the liquid phase refrigerant from said condenser to said evaporator;

whereby actuation of said actuator to shift said at least one second rotor or actuation of said valve varies capacity of said cooling system.

17. The cooling system of claim 16 further comprising:

a first thermocouple for measuring the temperature of the water at said water input of said tube; and a second thermocouple for measuring the temperature of the water at said water output of said tube;

whereby measured water temperatures are used to regulate the temperature of the water circulating in said tube.

18. The cooling system of claim 16 further comprising:

a processor for generating control signals in response to cooling requirements, said control signals for actuating said actuator or said valve.

19. The cooling system of claim 16 wherein said actuator comprises an electric stepper motor.

20. The compression of claim 19 wherein said stepper motor includes a drive shaft coupled to said at least one second rotor, whereby rotation of said drive shaft by said stepper motor shifts said at least one second rotor axially relative to said first rotor.

21. A compressor as claimed in claim 16 wherein said actuator comprises a solenoid.

22. The system of claim 16 wherein said condenser comprises an air or water cooled condenser.

23. The cooling system of claim 16 wherein:

said first rotor comprises a male rotor having a plurality of lobes with a degree of wrap; and said at least one second rotor comprises at least one female rotor having a plurality of flutes with a degree of wrap, said at least one second rotor being axially parallel with said first rotor.

24. The cooling system of claim 23 wherein said at least one female rotor comprises two, three, four or five female rotors.

* * * * *